United States Patent [19]

Sato et al.

[11] Patent Number: 4,525,719

[45] Date of Patent: Jun. 25, 1985

[54] DUAL-BAND ANTENNA SYSTEM OF A BEAM WAVEGUIDE TYPE

[75] Inventors: Ikuro Sato; Ryuichi Iwata, both of Tokyo, Japan

[73] Assignee: NEC Corporation, Tokyo, Japan

[21] Appl. No.: 511,614

[22] Filed: Jul. 7, 1983

[30] Foreign Application Priority Data

Jul. 12, 1982 [JP] Japan ..... 57-120927

[51] Int. Cl.[3] ..... H01Q 19/19

[52] U.S. Cl. ..... 343/761; 343/781 CA

[58] Field of Search ..... 343/761, 781 CH, 779, 343/781 P, 839

[56] References Cited

U.S. PATENT DOCUMENTS 4,260,993 4/1981 Aubry et al. ..... 343/781 CA 4,462,034 7/1984 Betsudan et al. ..... 343/781 CA

*Primary Examiner*—Eli Lieberman

*Attorney, Agent, or Firm*—Sughrue, Mion, Zinn, Macpeak & Seas

[57] ABSTRACT

In a dual-band antenna of the beam wave-guide type, first and second electromagnetic waves from first and second feed horns, respectively, are directly provided to a frequency selective reflector along different axes, with both electromagnetic waves being provided from the frequency selective reflector along the same axis. The two electromagnetic waves are then reflected in common by first and second concave mirrors and then provided substantially along an axis coincident with the azimuth axis to the remainder of the beam wave-guide section which is itself rotatable about the azimuth axis.

8 Claims, 4 Drawing Figures

DUAL-BAND ANTENNA SYSTEM OF A BEAM WAVEGUIDE TYPE

BACKGROUND OF THE INVENTION

The present invention relates to a dual-band antenna system of the beam waveguide type which is capable of varying the elevation and azimuth angles without limiting the settings of communications equipment or a transmitter/receiver.

A predominant type of large size antenna used for an earth station in a satellite communications system is the Cassegrain antenna, i.e., a dual reflector antenna having a main reflector and a subreflector. Associated with this type of antenna is a beam waveguide supply system which facilitates maintenance work and operation of communications equipment connected to the antenna, regardless of the rotatable antenna structure.

Prior art antenna systems employing such a beam waveguide supply system include those described in U.S. Pat. No. 3,845,483 (reference 1) assigned to NEC Corporation and issued Oct. 29, 1974, and U.S. Pat. No. 4,260,993 (reference 2) assigned to Thomson-CSF and issued Apr. 7, 1981.

The antenna system disclosed in reference 1 comprises at least a main reflector, a subreflector, two plane mirrors, two concave mirrors and an electromagnetic horn, as will be described. A drawback has existed in this type of antenna system in that, in feeding electromagnetic waves of dual (higher and lower) frequency bands (for example, 4 to 6 GHz and 11 to 14 GHz) to the antenna, the scope of design choice is limited because it is difficult to design and adjust a diplexer connected to the horn and adapted for the separation of the two frequency bands.

The antenna system of reference 2 is an attempt to overcome the drawbacks discussed above and employs another electromagnetic horn, a frequency selective reflector surface (referred to as a FSRS hereinafter) and three concave mirrors. The antenna system, as will be discussed in detail, includes two concave mirrors located in an electromagnetic path which leads from the horn allocated to one frequency band to the FSRS. While an electromagnetic path associated with the other frequency band has a single concave mirror therein, another concave mirror has to be furnished within this path so that the electrical characteristic of the antenna may not be effected by the rotation of the antenna in the azimuthal direction and thereby insure desirable cross polarization discrimination. Such a construction would naturally increase the number of concave mirrors in the system. Also, the propagation characteristics in the dual frequency bands are mutually different due to the difference in the surface accuracy between the two concave mirrors for the higher frequency band and those for the lower frequency band. This deteriorates the cross polarization discrimination.

SUMMARY OF THE INVENTION

It is therefore an object of the present invention to provide a high performance dual-band antenna system which, utilizing an FSRS, renders the antenna elevation and azimuth angles variable with a simple construction and without imposing any limitation on the settings of communications equipment, while also insuring desirable cross-polarization performance and a minimum of loss.

In accordance with the present invention, there is provided a dual-band antenna system of a beam waveguide type comprising a dual reflector antenna rotatable around elevation and azimuth axes, having a main reflector and a subreflector; first and second horn means for radiating first and second electromagnetic waves of first and second frequency bands, respectively; a beam waveguide means comprising first and second plane mirrors, first and second concave mirrors, for guiding the first and second electromagnetic waves to the dual reflector antenna by way of the first plane mirror, the first and second concave mirrors and the second plane mirror, the beam waveguide means being rotatable around the elevation and azimuth axes; and a frequency selective reflector surface means provided separately from the beam waveguide means, for passing the first electromagnetic wave and reflecting the second electromagnetic wave to feed them to the first plane mirror, characterized in that the first and second electromagnetic waves radiated from the first and second horn means are directly fed to the frequency selective reflector surface means and both the first and second electromagnetic waves provided from the frequency selective reflector surface means are fed to the first plane mirror by way of third and fourth concave mirrors.

BRIEF DESCRIPTION OF THE DRAWINGS

The objects and features of the present invention will become more apparent from a consideration of the following detailed description taken in conjunction with the accompanying drawings, in which.

DESCRIPTION OF THE PRIOR ART

In order to better understand the present invention, a description of some conventional beam waveguide arrangements will be given first.

Figure 1:
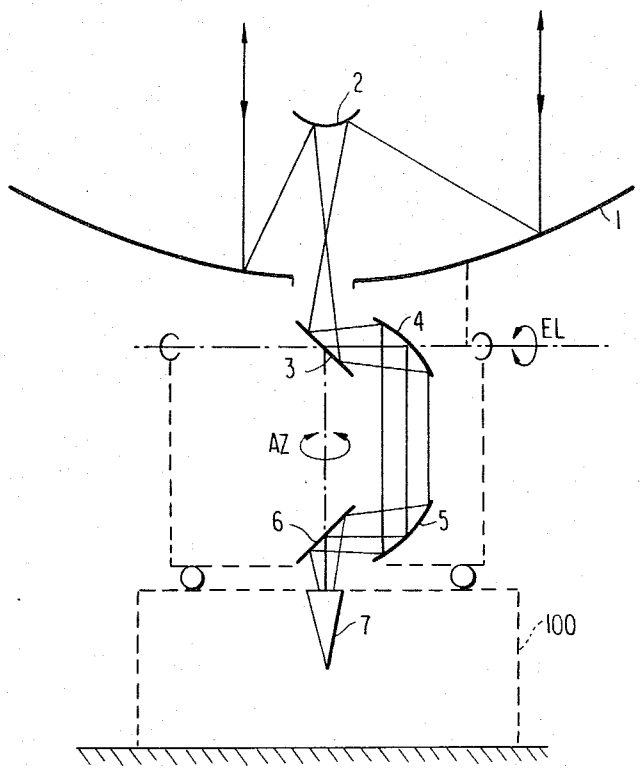
FIG. 1 PRIOR ART
FIG. 1 is a side elevation of a beam waveguide arrangement of a conventional antenna system to which the present invention is applicable.

Referring to FIG. 1, a beam waveguide of a conventional antenna system comprises a main reflector 1, a subreflector 2, plane mirrors 3 and 6, concave mirrors 4 and 5, and an electromagnetic horn 7. The main reflector 1 may be dimensioned 30 meters in diameter, for example. In this construction the horn 7 can be fixed in position inside a building 100 together with communications equipment (not shown), despite any rotation of the antenna which will occur about an axis of azimuth (AZ) or an axis of elevation (EL) to track a communications satellite. The antenna shown in FIG. 1 operates with a single frequency band (for example, 4 to 6 GHz). As previously described, where it is desired to share this type of antenna with another frequency band (for example, 11 to 14 GHz), difficulty is experienced in designing and adjusting a diplexer (not shown) which is connected to the horn, limiting the available scope of design choice.

Figure 2:
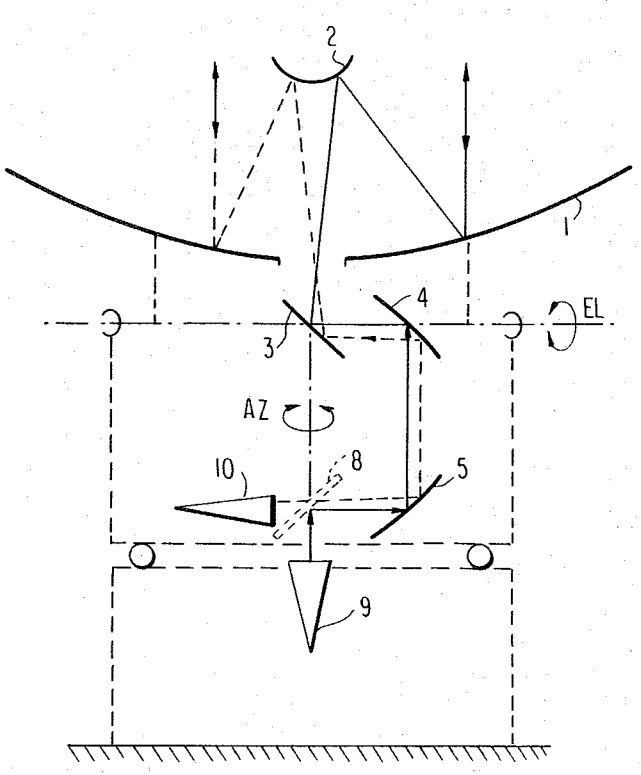
FIG. 2 PRIOR ART
FIG. 2 is a side elevation of a beam waveguide arrangement of a conventional dual-band antenna system.

An antenna system for accommodating such two frequency bands may be constructed as shown in FIG. 2. This system is distinguished from the system of FIG.

1 by the presence of an FSRS 8 in place of the plane mirror 6, and the provision of two electromagnetic horns 9 and 10. The FSRS 8 is available either as a "high pass" type which is transparent for a higher frequency band (for example, 11 to 14 GHz) and reflective for a lower frequency band (for example, 4 to 6 GHz), or as a "low pass" type which is reflective for the higher frequency band and transparent for the lower frequency band. The following description will concentrate on the high pass type reflector by way of example. In the case of transmission, for example, electromagnetic waves in the lower frequency band are emitted from the horn 9, reflected by the FSRS 8 and then led to the subreflector 2 by the mirrors 5, 4 and 3. Meanwhile, electromagnetic waves in the higher frequency band are emitted from the other horn 10, passed through the FSRS 8 and then directed toward the subreflector 2 by the mirrors 5, 4 and 3. This system, however, fails to achieve desirable electrical characteristics unless a low noise amplifier (not shown) is connected to the horn 10 through a feed system. Therefore, the communications equipment including the low noise amplifier rotates with the rotation of the antenna in the azimuthal direction, rendering the advantageous feature of the beam waveguide supply system, i.e. the fixed feed horn and related equipment, unavailable.

Figure 3:
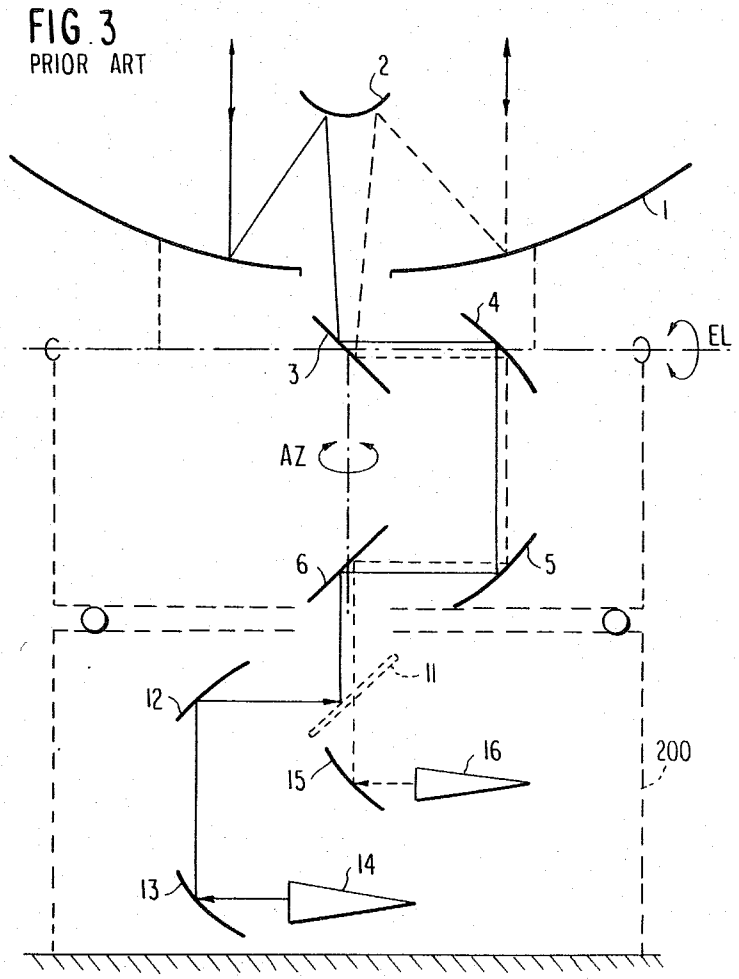
FIG. 3 PRIOR ART
FIG. 3 is a side elevation of a beam waveguide arrangement of another conventional dual-band antenna system.

A technique heretofore employed to resolve such a problem is shown in FIG. 3. The system of FIG. 3 has various elements thereof installed within a building 200 as illustrated, in contrast to the system of FIG. 1 in which only the horn 7 is inside the building 100. An FSRS 11 is located below the plane mirror 6. On transmission, electromagnetic waves in the lower frequency band are radiated from an electromagnetic horn 14 and then successively reflected by two concave mirrors 13 and 12. The waves from the concave mirror 12 are reflected by the FSRS 11 to be routed to the subreflector 2 by the mirrors 6, 5, 4 and 3. Meanwhile, electromagnetic waves in the higher frequency band are radiated from the other electromagnetic horn 16, reflected by a concave mirror 15, passed through the FSRS 11 and then successively directed toward the subreflector 2 by the mirrors 6, 5, 4 and 3. This type of system is advantageous over the system of FIG. 2 in that, despite the variable orientation of the antenna, the horns 14 and 16 as well as communications instruments directly connected thereto remain immobile inside the building 200.

Now, in the construction shown in FIG. 3, two concave mirrors (12 and 13) are positioned in the path of the lower frequency band waves. This makes the wave propagation mode between the FSRS 11 and the mirror 6 symmetrical with respect to the azimuth axis. Therefore, the electrical characteristics of the antenna are not changed with the rotation of the antenna in the azimuthal direction, and high cross-polarization discrimination is achieved. To insure these features in the higher frequency band as well, another concave mirror is required in addition to the concave mirror 15. This would naturally increase the number of necessary mirrors. Also, the propagation characteristics (for example, propagation scattering and propagation loss) in the dual frequency bands are different each other due to the difference in the surface accuracy between two concave mirrors for the higher frequency band and those for the lower frequency band. This invites deterioration to the cross polarization discrimination.

DESCRIPTION OF THE PREFERRED EMBODIMENT

Figure 4:
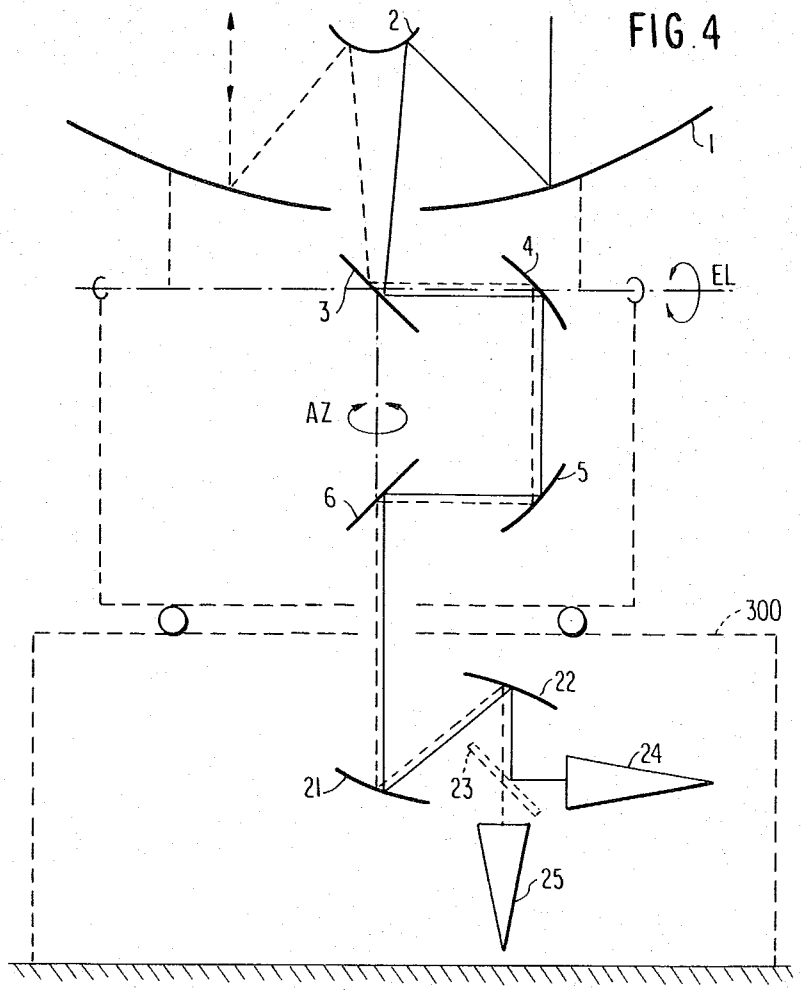
FIG. 4 is a side elevation of a beam waveguide arrangement in accordance with one embodiment of the present invention.

Referring now to FIG. 4, a preferred embodiment of the present invention is shown which constitutes a solution to the problems discussed hereinabove. The beam waveguide according to the present invention is shown in FIG. 4 in the context of a Cassegrain antenna. It should be noted that the components of the Cassegrain antenna section, from the main reflector 1 and subreflector 2 to the mirrors 3 and 4 in the elevational movement section and the mirrors 5 and 6 in the azimuthal movement section, are common in function to those of FIG. 1 which are designated by the same reference numerals. Inside a building 300 having communications equipment therein, a beam waveguide is constructed between the plane mirror 6 and two electromagnetic horns 24 and 25 by concave mirrors 21 and 22 and an FSRS 23. Taking transmission for example, waves in the lower frequency band are radiated from the horn 24, reflected by the FSRS 23 of the high pass type, and then successively reflected by the concave mirrors 22 and 21 to become incident on the plane mirror 6. On the other hand, waves in the higher frequency band are radiated from the other horn 25, passed through the FSRS 23 and then directed toward the plane mirror 6 by the concave mirrors 22 and 21.

In the construction described above, the higher and lower frequency band waves share the two concave mirrors 21 and 22 to reduce the number of necessary mirrors and more effectively utilize them, compared to the conventional construction shown in FIG. 3. Another advantageous feature of such a construction is that the combination of the concave mirrors 21 and 22 sets up a rotation-symmetrical wave propagation mode between the plane mirror 6 and the concave mirror 21.

In the embodiment shown and described, the FSRS 23 comprises a high pass reflector in which metal conductor members are arranged in a grid. If desired, however, the FSRS 23 may comprise a low pass type reflector with the horn 24 being be allocated to the higher frequency band and the horn 25 to the lower frequency band. The low pass type FSRS may comprise spaced square conductor films arranged on the surface of a dielectric panel.

While the beam waveguide applied to the particular embodiment employs plane mirrors at the positions designated 3 and 6 and concave mirrors at the positions designated 4 and 5, it will be noted that the number, kind, combination, location and the like of such mirrors are not limited thereto.

In summary, it will be seen that the dual-band antenna system of the present invention features various advantages both in performance and maintenance such as enhancing the cross polarization discrimination and suppressing the loss each with the addition of a simple structure, not to speak of making the elevation and azimuth angles variable. These advantages are attainable merely by dividing a feed horn into two horns assigned to different frequency bands and locating two concave mirrors and an FSRS between the two horns and a mirror adapted to couple a beam following the azimuth axis.

What is claimed is:

1. A dual-band antenna system of a beam waveguide type comprising a dual reflector antenna rotatable around elevation and azimuth axes, having a main reflector and a subreflector; first and second horn means for radiating first and second electromagnetic waves of first and second frequency bands, respectively; a beam waveguide means comprising first and second plane mirrors and first and second concave mirrors, for guiding said first and second electromagnetic waves to said dual reflector antenna by way of said first plane mirror, said first and second concave mirrors and said second plane mirror, said beam waveguide means being rotatable around said elevation and azimuth axes; and a frequency selective reflector surface means, provided separately from said beam waveguide means, for passing said first electromagnetic wave and reflecting said second electromagnetic wave to feed them to said first plane mirror, characterized in that said first and second electromagnetic waves radiated from said first and second horn means are directly fed to said frequency selective reflector surface means and both the first and second electromagnetic wave provided from said frequency selective reflector surface means are fed to said first plane mirror by way of third and fourth concave mirrors.

2. A dual-band, beam wave-guide type antenna system comprising a dual reflector antenna having a main reflector and a subreflector and being rotatable about elevation and azimuth axes, first and second feed horns for radiating first and second electromagnetic waves of first and second frequencies, respectively, and beam wave-guide means for coupling said first and second electromagnetic waves from said first and second horn means to said subreflector, said beam wave-guide means comprising:

frequency selective reflector means for receiving said first electromagnetic wave from said first feed horn and reflecting said first electromagnetic wave substantially along a first path, and for receiving said second electromagnetic wave from said second feed horn and passing said second electromagnetic wave substantially along said first path;

a first reflector for receiving electromagnetic waves along said first path from said frequency selective reflector means and for reflecting said electromagnetic waves along a second path; and a second reflector for receiving electromagnetic waves along said second path from said first reflector and for reflecting said electromagnetic waves along a third path substantially coincident with said azimuth axis.

3. An antenna system as claimed in claim 2, wherein said first and second reflectors are concave mirrors.

4. An antenna system as claimed in claim 3, wherein said first and second electromagnetic waves are fed to said frequency selective reflector means from said first and second feed horns, respectively, without the intermediary of any reflective surfaces.

5. An antenna system as claimed in claim 2, wherein said beam wave-guide means further comprises rotating means (3, 4, 5, 6), rotatable with said antenna about said azimuth axis and rotatable with respect to said antenna about said elevation axis, for receiving said electromagnetic waves along said third path and providing said electromagnetic waves to said subreflector.

6. An antenna system as claimed in claim 5, wherein said rotating means comprises a first plane mirror for receiving electromagnetic waves along said third optical path and reflecting said electromagnetic waves, a first concave mirror for receiving and reflecting electromagnetic waves reflected by said first plane mirror, a second concave mirror for receiving and reflecting electromagnetic waves reflected by said first concave mirror, and a second plane mirror for receiving electromagnetic waves reflected by said second concave mirror and reflecting said electromagnetic waves to said subreflector.

7. An antenna system as claimed in claim 6, wherein said first and second plane mirrors and first and second concave mirrors are all rotatable with respect to said azimuth axis, with said second concave mirror and second plane mirror being also rotatable with said antenna with respect to said elevation axis.

8. An antenna system as claimed in claim 7, wherein said first reflector is a third concave mirror and said second reflector is a fourth concave mirror.

* * * * *